US010246817B2

(12) United States Patent
Wang et al.

(10) Patent No.: US 10,246,817 B2
(45) Date of Patent: Apr. 2, 2019

(54) TREATMENT OF A FABRIC ARTICLE

(71) Applicant: KONINKLIJKE PHILIPS N.V., Eindhoven (NL)

(72) Inventors: Yuqi Wang, Eindhoven (NL); Weiran Wang, Eindhoven (NL); Yong Jiang, Eindhoven (NL); Boon Teck Tan, Eindhoven (NL); Jiuyu Zhou, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 27 days.

(21) Appl. No.: 14/439,691

(22) PCT Filed: Oct. 25, 2013

(86) PCT No.: PCT/IB2013/059649
§ 371 (c)(1),
(2) Date: Apr. 30, 2015

(87) PCT Pub. No.: WO2014/068462
PCT Pub. Date: May 8, 2014

(65) Prior Publication Data

US 2015/0292143 A1 Oct. 15, 2015

(30) Foreign Application Priority Data

Nov. 2, 2012 (WO) ..... PCT/CN2012/084023

(51) Int. Cl.

| | |
|---|---|
| ***D06M 10/00*** | (2006.01) |
| ***D06M 11/32*** | (2006.01) |
| ***D06M 11/34*** | (2006.01) |
| ***D06F 58/10*** | (2006.01) |
| ***D06F 58/26*** | (2006.01) |
| ***D06M 10/02*** | (2006.01) |
| ***D06F 58/20*** | (2006.01) |

(52) U.S. Cl.
CPC ..... *D06M 10/001* (2013.01); *D06F 58/10* (2013.01); *D06F 58/26* (2013.01); *D06M 10/025* (2013.01); *D06M 11/32* (2013.01); *D06M 11/34* (2013.01); *D06F 58/203* (2013.01)

(58) Field of Classification Search
CPC .. D06M 10/001; D06M 10/025; D06M 11/32; D06M 11/34; D06F 58/10; D06F 58/26; D06F 58/203
See application file for complete search history.

(56) References Cited

U.S. PATENT DOCUMENTS

| | | | | |
|---|---|---|---|---|
| 2,660,806 | A | 12/1953 | Whitesel | |
| 5,997,619 | A | 12/1999 | Knuth | |
| 6,524,529 | B1 * | 2/2003 | Horton, III | A61L 2/10 210/636 |
| 7,055,262 | B2 | 6/2006 | Goldberg | |
| 8,450,420 | B2 | 5/2013 | Sakurai | |
| 2003/0108460 | A1 * | 6/2003 | Andreev | A23L 3/3409 422/186.07 |
| 2008/0213125 | A1 | 9/2008 | Boast | |
| 2010/0028201 | A1 * | 2/2010 | Neister | A61L 2/0011 422/24 |
| 2010/0236296 | A1 | 9/2010 | Choi | |

FOREIGN PATENT DOCUMENTS

| | | | | |
|---|---|---|---|---|
| CN | 1666782 | A | | 9/2005 |
| CN | 201071470 | Y | * | 6/2008 |
| CN | 101285259 | | * | 10/2008 |
| CN | 101285259 | A | | 10/2008 |
| CN | 101285260 | A | | 10/2008 |
| CN | 201938780 | U | | 8/2011 |
| DE | 102007037984 | A1 | | 2/2009 |
| EP | 1696071 | | * | 8/2006 |
| EP | 1696071 | A1 | | 8/2006 |
| EP | 2330247 | | * | 6/2011 |
| EP | 2330247 | A1 | | 6/2011 |
| JP | 2002275756 | A | | 9/2002 |
| JP | 2004317361 | A | | 11/2004 |
| JP | 2005300913 | A | | 10/2005 |
| JP | 02012040120 | | * | 3/2012 |

OTHER PUBLICATIONS

Machine translation EP 2330247, Jun. 2011.*
Zafira Bilimis: "Measuring the UV protection factor (UPF) of fabrics and clothing", Mar. 1, 2011.
https://www.ebay.de/p/Varian-Cary-3e-Uv-visible-Spectrophotometer/2024415823.

* cited by examiner

*Primary Examiner* — Amina S Khan

(57) ABSTRACT

The present application relates to a method of treating a fabric article so that it has a characteristic smell normally associated with garments that have been exposed to natural sunlight, the method comprising positioning a fabric article (1) to be treated in an enclosure (8) and irradiating said fabric article positioned in said enclosure with ultraviolet light with a wavelength of between 280 nm and 400 nm and so that it is subjected to a predetermined radiant exposure. A device for treating a fabric article to replicate the characteristic effect of exposing said fabric article to natural sunlight is also disclosed.

6 Claims, 4 Drawing Sheets

TREATMENT OF A FABRIC ARTICLE

This application is the U.S. National Phase application under 35 U.S.C. § 371 of International Application No. PCT/IB2013/059649, filed on Oct. 25, 2013, which claims the benefit of International Application No. PCT/CN2012/084023 filed on Nov. 2, 2012. These applications are hereby incorporated by reference herein.

FIELD OF THE INVENTION

This invention relates to a device and a method for treating a fabric article so that it has a characteristic smell normally associated with fabric articles that have been exposed to natural sunlight.

BACKGROUND OF THE INVENTION

Conventional garment washing processes, such as washing machines, are not able to remove all unwanted dirt, odours and organisms, such as bacteria. Furthermore, drying garments in an enclosed space, such as indoors, is limited and can lead to unpleasant odours, dampness and mould.

Drying and/or exposing garments in direct and natural sunlight is preferable because it leaves the garment with a clean feel and unique characteristics that cannot otherwise be achieved. The characteristics that are obtained as a result of exposing clothes to natural sunlight are considered pleasant and desirable and includes a characteristic smell that may be referred to as a 'sunshine scent'.

However, if the local environment is not suitable then it may not be possible to hang garments in direct sunlight. For example, it is not possible to hang garments outdoors if the weather is wet, windy or cold, or if local air pollution is prohibitive. Furthermore, some people may not have access to appropriate outdoor areas. In such situations, users have to either use a clothes dryer (e.g. U.S. Pat. No. 2,660,806) or hang the garments on lines or rack indoors. However, neither of these methods will result in the garments having the distinctive characteristic smell of a garment that has been dried in the sunshine.

SUMMARY OF THE INVENTION

It is an object of the invention to provide a method and a device for treating a fabric article which substantially alleviates or overcomes the problems mentioned above and which provides garments with a characteristic smell that is normally associated with exposing such garments to natural sunlight.

A garment exposed to natural sunlight will be exposed to light with a wide range of wavelengths but it has been determined that it is light within the ultraviolet parts of the electromagnetic spectrum that is responsible for generating the desired effect and which provides the garments with the desired sunshine scent. The present invention is therefore concerned with irradiating fabric articles with ultraviolet light of a predetermined range of wavelength.

According to the present invention, there is provided a method of treating a fabric article so that it has a characteristic smell normally associated with garments that have been exposed to natural sunlight, the method comprising positioning a fabric article to be treated in an enclosure and irradiating said fabric article positioned in said enclosure with ultraviolet light with a wavelength of between 280 nm and 400 nm and so that it is subjected to a predetermined radiant exposure.

The radiometric quantity "radiant exposure" is the product of image-plane irradiance $E_e$ and time, and provides the accumulated amount of incident "light" energy per area:

$$H_e = E_e \cdot t$$

where $H_e$ is the radiant exposure (joules per square metre ($J/m^2$))

$E_e$ is the irradiance (watts per square metre ($W/m^2$)), also commonly referred to as intensity t is the exposure time (in seconds)

Ultraviolet light with the defined wavelength and having a predetermined radiant exposure will provide the fabric article with a pleasant characteristic smell similar to that obtained as a result of exposing garments to natural sunlight.

Ultraviolet light with a wavelength lower than 280 nm will interact more with the fabric article and may cause bleaching and deterioration of the fabric article without obtaining the characteristic smell. Light with a wavelength above 400 nm (up to about 700 nm) is in the visible spectrum and interacts less with the article and therefore is also incapable of generating the desired smell.

It is possible to use this artificial treatment in a more effective manner than achieved by natural sunlight because the conditions are more controllable and can be optimised. Radiation from the sun varies over time and is not always effective, whereas artificial treatment can be adjusted to maintain preferred conditions for the required period of time. It is therefore also possible, with the right combination of intensity, to achieve the required characteristic smell within a shorter period of time than actual sun dried laundry.

Different wavelength ultraviolet light may have different effects on the fabric article. Therefore, to ensure adequate performance and avoid causing damage or deterioration to the fabric article, the intensity of the ultraviolet light should be adjusted depending on the wavelength. The treatment time will therefore need to be adjusted accordingly. For more effective generation of the characteristic smell, a combination of the intensity ratio of the ultraviolet light with a wavelength between 280-320 nm and ultraviolet light with a wavelength between 320-400 nm ranging between 1:2 and 1:30 is preferred. More advantageously, a ratio between 1:4 and 1:30 can be used.

A minimum radiant exposure, which is the product of intensity and the time, of 12 $kJ/m^2$ on the fabric is found to be sufficient. This means that using a lower intensity will require a longer treatment time, whereas using a higher intensity will enable a shorter treatment time. Measurement of the intensity and also the radiant exposure can easily be done by using a CCD (Charge-Coupled Device) array base spectrometer.

Preferably, the predetermined radiant exposure is at least 12 $kJ/m^2$. More preferably, the predetermined minimum exposure is at least 18 $kJ/m^2$.

Preferably, the fabric article also needs to be dry at the end of the treatment process. If the fabric is wet, the molecules are trapped within the water and do not escape easily into the atmosphere. Hence, the sun-dried characteristics and smell may not be perceivable by users. But for a dry fabric, the molecules can escape easily and spread into the nearby surroundings. The dryness of the fabric would depend on the relative humidity of the air, but a typical moisture content by mass of 10% or less is sufficient to ensure the effect.

One typical example is to treat garment of cotton fabric with UV light of 280-400 nm for a period of 30 minutes, at intensity of 15 $W/m^2$, to achieve a radiant exposure of 27 $KJ/m^2$. In this example the smell on the cotton based fabric is easily recognizable by users as one which is similar to that which is obtained as a result of being dried in natural sunlight.

The method may further comprise the step of providing ozone to the vicinity of said article being treated at a concentration of between 0.02 and 0.2 parts per million.

A small concentration of ozone in the vicinity of the fabric article, while the article is exposed to ultraviolet light, act as a catalyst to accelerate the photochemical reaction, resulting in a shorter treatment time needed to generate the characteristic sunshine scent, as compared to treatment with ultraviolet irradiation only.

According to the first embodiment of the invention, there is provided a device for treating a fabric article to provide the fabric article with a characteristic smell normally associated with fabric articles that have been exposed to natural sunlight comprising an enclosure to receive a fabric article to be treated, and an ultraviolet lamp for irradiating the article with ultraviolet light, at a wavelength of between 280 nm and 400 nm. A controller can also be provided such that it is configured to control the ultraviolet lamp so that the fabric article is subjected to a predetermined radiant exposure.

Preferably, the predetermined radiant exposure is at least 12 $kJ/m^2$, but more preferably it is at least 18 $kJ/m^2$.

In a preferred embodiment, the controller is configured to control one or more ultraviolet lamps to irradiate said fabric article with ultraviolet light having a wavelength of between 280 nm and 320 nm and, a wavelength of between 320 nm and 400 nm. The article may be irradiated with light of different wavelengths at the same time or subsequently to each other. For example, the garments may be exposed to one wavelength of ultraviolet light for a first predetermined period of time and then exposed to a second wavelength for a second predetermined period of time.

The controller may be configured to control the ultraviolet lamp so that the intensity ratio between ultraviolet light with a wavelength between 280 nm and 320 nm and ultraviolet light with a wavelength between 320 nm and 400 nm, is between 1:2 and 1:30. Preferably, the intensity ratio can be between 1:4 and 1:30.

Preferably, the controller is configured to switch off the ultraviolet lamp once the required radiant exposure is achieved. This reduces power consumption and so makes the device more efficient. It also ensures that the characteristic sunshine smell is generated.

In some embodiments, the enclosure comprises an inlet port and an outlet port and at least one fan is provided to draw air into the enclosure via the inlet port and out of the enclosure via the outlet port. This has the effect of treating garments that are placed in the vicinity of the device. For example, the device may be placed in a wardrobe so that air exiting the device circulates around garments placed in the wardrobe and imparts some of the desired characteristic smell to them.

The device may comprise a plasma or ion generator so that charged particles are distributed to a region surrounding the device in the air exiting the enclosure via the outlet port. This has the effect of causing the scent molecules to be charged and better attach to the fabric article, resulting in longer lasting scent.

The device may further comprise an ozone generator for providing ozone to the enclosure.

The ozone generator may be configured to generate an ozone concentration of between 0.02 and 0.2 parts per million in order to accelerate the generation of the characteristic smell. A fan or other device to provide convection currents within the disclosure may be provided to distribute the ozone within the enclosure.

A small concentration of ozone within the enclosure, in the vicinity of the fabric article, while the ultraviolet light is irradiating the article, act as a catalyst to speed up the photochemical reaction, resulting in a shorter treatment time needed to generate the 'sunshine scent', as compared to treatment with ultraviolet irradiation only.

The outlet port may comprise a filter to remove ozone from the air leaving the enclosure via the outlet port. This prevents any harmful residual ozone from escaping from the enclosure. In some embodiments, the enclosure may comprise a door and a timer lock to prevent the door being opened for a predetermined period of time once the treatment has finished. This also allows any residual ozone to disintegrate and prevent it from escaping to the atmosphere.

The device may further comprise a heater to heat said article or the air inside the enclosure. An infrared heater may also be used as an alternative.

This may be provided for replicating the drying effects of exposing an article to natural sunlight. The heat from the heater will dry the article while the ultraviolet light will impart a smell to the article similar to that of sun dried laundry.

The enclosure may comprise an inlet port and an outlet port and at least one fan configured to draw air into the enclosure via the inlet port and out of the enclosure via the outlet port.

The fan and ports generate a flow of air through the enclosure which ensures that any ozone within the enclosure is evenly distributed. Furthermore, the flow of air may be heated, or an infrared heater may be provided to heat the article. A heated flow of air is effective for drying a wet fabric article and also for carrying water vapour out of the enclosure, ensuring that the humidity within the enclosure is not prohibitive to further drying.

The interior of the enclosure may comprise a plurality of UV-reflective surfaces which have UV-reflectivity of 80% or above.

The UV-reflective surfaces will increase the effectiveness of the ultraviolet light treatment because any light that does not directly interact with the fabric article may be reflected once or several times until it is incident on the article. Therefore, a higher proportion of the light emitted by the ultraviolet lamp will be incident on the article, reducing the power requirements of the lamp. In the situation where a plurality of garments are placed within the device, the spacing between the garments become important to control to ensure that sufficient ultraviolet irradiation can still reach the garment surfaces in between. Hence a minimum pitch of 3 cm in between garments is needed, and a minimum pitch of 5 cm is preferred.

In addition, to ensure that the ultraviolet irradiation will have a good coverage incident upon the garments within the enclosure, either the garment position and orientation can be made adjustable, or the ultraviolet source can be made adjustable by moving the lamps or the reflectors. The movement of the garment, lamp, or reflector can follow a predetermined pattern such that each garment will have sufficient radiant exposure to generate the 'sunshine scent' within the operating cycle time of the device.

The outlet port may comprise a filter configured to remove ozone from the air leaving the enclosure via the outlet port.

According to another aspect of the invention, there is provided a device for treating a fabric article to provide the fabric article with a characteristic smell normally associated with fabric articles that have been exposed to natural sunlight, said device being positionable within a space, such as a wardrobe, in which a fabric article to be treated has been placed, wherein the device comprises a controller, an ultraviolet lamp for irradiating air in the device with ultraviolet light at a wavelength of between 280 nm and 400 nm and, a fan for generating a flow of air through the device so that irradiated air is fed into the enclosure, wherein the controller is configured to control the ultraviolet lamp so that air passing through the device is subjected to a predetermined radiant exposure.

The above aspect of the invention may include many of the preferred features of the first aspect of the invention identified herein. The device according to the second aspect may either have no facility for placing garments within it and so only treat the air that flows through it. Alternatively, it may be possible to place some garments within the device so that those garments are treated directly whereas other garments in the vicinity of the device are indirectly treated as a result of the air passing through the device. In order to maximise the effect of the treated air passing through the device, it may ideally be suited and dimensioned for being placed within a wardrobe or cupboard so that treated air emitted from the device circulates around the garments hanging or placed in the cupboard rather than simply escaping into the surroundings. However, it is envisaged that the device could be placed in a room so as to circulate treated air throughout the entire room, thereby treating fabrics in the whole room.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF EMBODIMENTS

It is desirable to treat garments in a controlled space to provide them with a similar characteristic smell that is obtained as a result of exposing garments to natural sunlight. The treatment may also include a drying process, for treating wet garments, such as those recently washed. In this way, garments can be treated at any time and the treatment is not reliant on any environmental conditions, such as the weather.

A garment exposed to natural sunlight will be exposed to light with a wide range of wavelengths but it has been determined that it is light within the ultraviolet parts of the electromagnetic spectrum that is responsible for generating the desired effect and which provides the garments with the desired sunshine scent. The present invention is therefore concerned with irradiating fabric articles with ultraviolet light of a predetermined range of wavelength.

Figure 1:
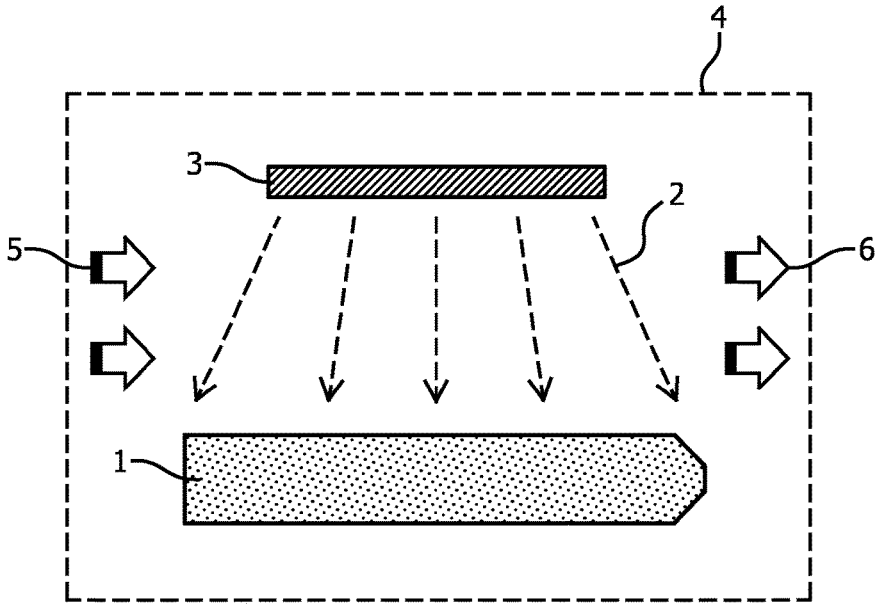
FIG. 1 shows a schematic diagram of a method for treating a fabric article according to one aspect of the invention.

FIG. 1 shows a schematic diagram of a method for refreshing a fabric article of garment or linen 1. The method includes generating ultraviolet light 2 which is directed towards the garment 1. The ultraviolet (UV) light 2 is generated from a source, such as a lamp 3, which generates light within a specific range of wavelength and at a specific, predetermined, intensity which mimics the effects of exposing the garment to direct sunlight, to provide the characteristic smell to the garment.

In particular, UV light 2 may be generated at a wavelength of between 280 nm and 400 nm. This spectrum of UV light has been identified as being most effective at generating the desired effect when garments are exposed to it. The radiant exposure of the UV light irradiating onto the garment 1 is also significant.

The radiometric quantity "radiant exposure" is the product of image-plane irradiance $E_e$ and time, and provides the accumulated amount of incident "light" energy per area:

$$H_e = E_e \cdot t$$

where $H_e$ is the radiant exposure (joules per square metre ($J/m^2$))

$E_e$ is the irradiance (watts per square metre ($W/m^2$)), also commonly referred to as intensity t is the exposure time (in seconds)

In one example, the magnitude of the UV radiant exposure may be in the region of 27 $kJ/m^2$ of garment surface being exposed to the UV light. However, the minimum radiant exposure is preferably 12 $kJ/m^2$ or more preferably, 18 $kJ/m^2$. The radiant exposure will vary depending on several factors, including the intensity of UV light 2 being employed, the treatment time, as well as the size and type of garment 1 being treated. Therefore, it is more useful to consider the relationship between the intensity of the UV light being employed and the treatment time at which it operates.

A narrower spectrum of UV light may be employed. For example UV light having a wavelength of between 280 nm and 320 nm or between 320 nm and 400 nm. In another embodiment, the garments may be exposed to UV light having a different range of wavelengths. For example, they may be exposed to a UV light of between 280 nm and 320 nm for a first predetermined period of time and UV light of between 320 nm and 400 nm for a second predetermined period of time. If the UV light wavelength is combined in this manner then the intensity will also have to be altered to account for the different interactions between the UV light 2 and the garment 1. Generally, the intensity from UV light in the range 320 nm to 400 nm is preferred to be higher than the intensity from UV light in the range 280 nm to 320 nm. The ratio between the intensities preferred for the ranges of wavelengths (280 nm-320 nm):(320 nm-400 nm) will be between 1:2 and 1:30. This ratio is more advantageous between 1:4 and 1:30. This is because different wavelength UV light interacts with the garment differently and creates a different effect. Varying the wavelength and intensity will vary the effect on the garment and the extent to which the garment has the same characteristics and, more specifically, the characteristic smell that is obtained as a result of exposing the garment to sunlight.

The wavelength and intensity of the UV light 2 can be adjusted to suit the configuration of the UV light source 3, garment 1 and the space 4 in which the treatment occurs. It is possible to use this artificial treatment in a more effective manner than achieved by natural sunlight because the conditions are more controllable and can be optimised. Radiation from the sun varies over time and is not always effective, whereas artificial treatment can be adjusted to maintain preferred conditions for the require period of time. It is therefore also possible, with the right combination of intensity, to achieve the required characteristic smell within a shorter period of time than actual sun dried laundry.

Use of UV light outside of the ranges described above may lead to an undesirable, pungent smell being created. Use of lower wavelength UV light (<280 nm) interacts far more with the garment and generates an undesirable smell. Lower wavelengths of UV light may excessively degrade the material of the garment and create a burning odour. Furthermore, lower wavelength UV light (<280 nm) also causes bleaching and discoloration of dyes in the garment which will cause fading, deterioration and damage. Light with a wavelength greater than 400 nm (up to around 700 nm) is in the visible spectrum and will have little effect on the garment and will not interact with the garment in the required manner.

In another embodiment of the method shown in FIG. 1, at the same time as being exposed to UV light 2, the garment 1 is also exposed to air 5 with a higher than ambient concentration of ozone ($O_3$). Ozone acts as a photocatalyst such that the presence of a small concentration of ozone while the UV light 2 interacts with the garment 1 has been shown to increase the rate at which the desired characteristic smell is generated. In particular, the concentration of ozone in the air 5 surrounding the garment should be between 0.02 and 0.2 parts per million (ppm).

Ozone is highly oxidising and hazardous to humans, even at relatively low concentrations. Therefore, this treatment should be carried out in a closed environment 4 and release of ozone into the surrounding area should be controlled. Apparatus for achieving this will be described in more detail later. Ozone has a half-life of about 30 minutes at sea level before it breaks down into dioxygen ($O_2$). Furthermore, ozone is a strong oxidising agent so will react with other substances if it comes into contact with them. Therefore, the concentration of ozone within the air will naturally fall once ozone has stopped being produced. However, residual ozone may be removed from the air 5 within the closed space 4 at the end of a treatment cycle, as explained in more detail later. The ozone rich air may be provided to the garment 1 as a flow of air 6 which passes over the garment 1 as the UV light 2 interacts with the garment 1.

The method described with reference to FIG. 1 may be adapted for drying a wet garment as part of the treatment process. If the method is being used to dry a garment 1, then the flow of air 6 moving over the garment may be heated. Alternatively or additionally, infrared radiation (not shown) may be generated and directed onto the wet garment 1 to heat and evaporate water. The flow of air can be drawn from and ejected into the surrounding atmosphere to carry the evaporated water vapour away from the garment 1 and prevent high humidity in the vicinity of the garment which would hinder further evaporation and be detrimental to the drying process.

The method described with reference to FIG. 1 can be used to generate the characteristic smell associated with exposing the garments to direct sunlight by using UV light 2. Ozone may also be provided to accelerate the treatment. Furthermore, the method may include providing a flow of heated air 6 and/or directly heating the garment 1, so that a wet garment is dried as well as treated.

Figure 2:
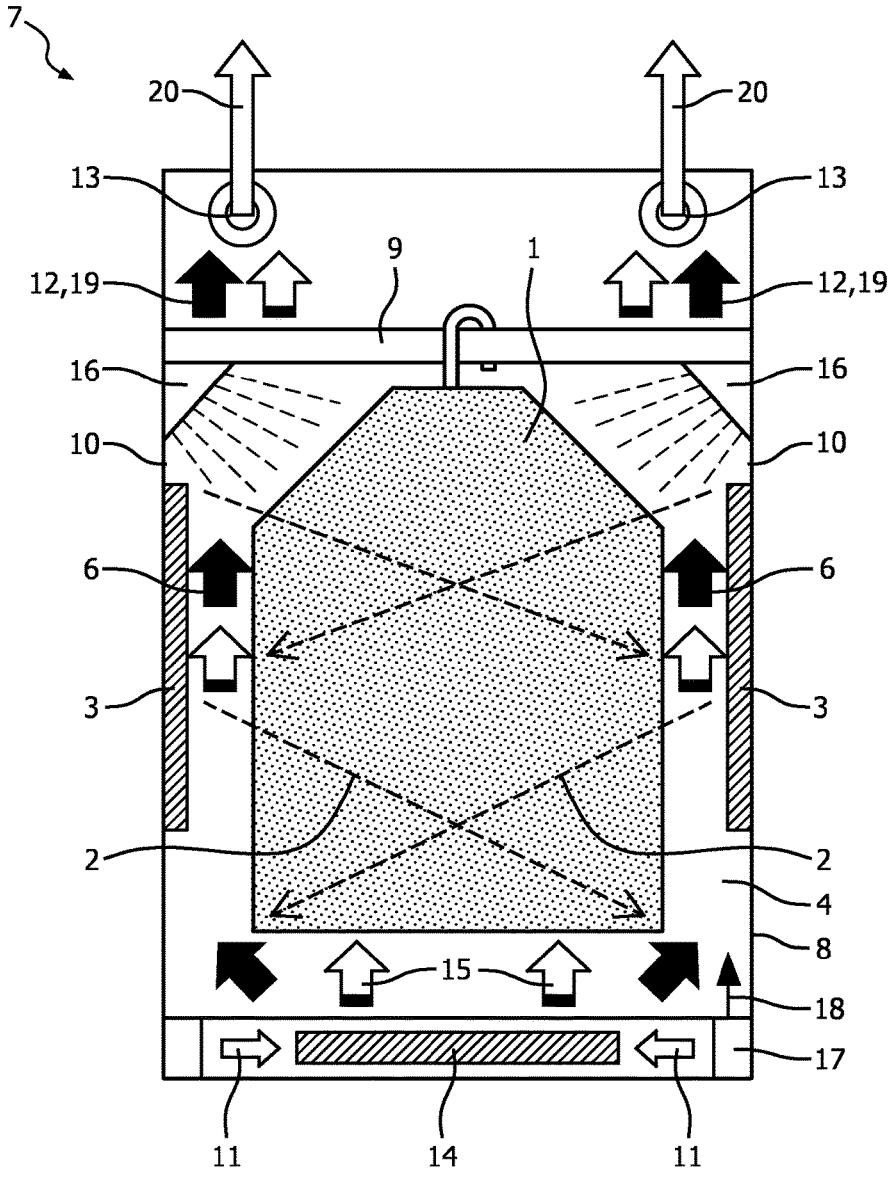
FIG. 2 shows a device for treating a garment, employing the method of FIG. 1.

FIG. 2 shows a device 7 for treating an article, such as a garment 1, that employs the method described with reference to FIG. 1. The device 7 replicates the effect of exposing garments to natural sunlight in order to generate the characteristic smell and can additionally be used to dry a wet garment 1.

The device 7 includes an enclosure 8 which defines a closed interior space 4 within which at least one garment 1 may be placed. The enclosure 8 may have an opening (not shown) which is closable, for example by a hinged door or a zipper, so that the enclosure 8 can be opened for moving garments 1 into and out of the interior 4 of the enclosure 8. The garment 1 may be hung within the enclosure 8, as shown in FIG. 1, on a hanger 9 or similar arrangement so that the garment 1 hangs freely and air can move and flow around and within the garment 1. The enclosure may comprise a self-supporting rigid structure or a flexible bag-like structure which is hung to expand an interior space. Alternatively, the enclosure may comprise a flexible skin suspended on a rigid frame.

The device 7 includes at least one source of ultraviolet (UV) light 2, such as a UV lamp 3 disposed within the enclosure 8 to emit UV light 2 onto the garment 1 being treated. As previously explained, the interaction between the UV light 2 and the garment 1 will generate a characteristic smell in the garment that replicate those characteristics found in garments that have been exposed to natural sunlight. The wavelength of the UV light 2 being emitted by the UV lamp 3 is between 280 nm and 400 nm. As previously explained, the intensity at which the lamp 3 operates will vary depending on the wavelength of UV light 2 being emitted as well as the surface area of the garment 1 being treated and the interior size of the enclosure 8. However, the UV radiant exposure should be above 12 $kJ/m^2$ and preferably above 18 $kJ/m^2$. It is also helpful to consider the ratio between the different intensities for the UV lamp 3 operating wavelength ranges of 280 nm to 320 nm and 320 nm to 400 nm. This ratio may be between 1:2 and 1:30, more preferably between 1:4 and 1:30.

As shown in FIG. 2, this example has two UV lamps 3 positioned within the enclosure 8 on side walls 10. However, if the enclosure 8 were made of a transparent material then the UV lamps 3 may be placed outside the enclosure 8 and disposed to irradiate UV light 2 through the transparent enclosure 8 and onto the garment 1 within. Furthermore, the UV lamps 3 may be placed in any location within the enclosure 8, so long as they irradiate UV light 2 onto the garment 1 and preferably directly irradiate as much of the garment 1 as possible.

To increase the amount of a garment 1 that is irradiated by the UV lamps 3, the interior of the enclosure 8 may be provided with UV-reflective surfaces (not shown), such as mirrored (for example, using aluminium) or white surfaces (for example, using $CaCO_3$ or $BaSO_4$) that has a UV-reflectivity of 80% or more. In this way, UV light 2 emitted from the UV lamps 3 that is not directly incident on the garment 1 will be reflected within the enclosure 8 until it does interact with the garment 1. This will increase the intensity of UV light 2 which interacts with the garment 1 without having to increase the power of the UV lamps 3.

In the situation where a plurality of garments are placed within the device, the spacing between the garments become important to control to ensure that sufficient ultraviolet irradiation can still reach the garment surfaces in between. Hence a minimum pitch of 3 cm in between garments is needed, and a minimum pitch of 5 cm is preferred.

In addition, to ensure that the ultraviolet irradiation will have a good coverage incident upon the garments within the enclosure, either the garment position and orientation can be made adjustable, or the ultraviolet source can be made adjustable by moving the lamps or the reflectors. The movement of the garment, lamp, or reflector can follow a predetermined pattern such that each garment will have sufficient radiant exposure to generate the 'sunshine scent' within the operating cycle time of the device.

The enclosure 8 also comprises at least one inlet port 11 and at least one outlet port 12 and during use the enclosure 8 is closed so that the interior 4 of the enclosure 8 is a sealed space except via the inlet and outlet ports 11, 12. In this embodiment, the device has two inlet ports 11, located towards the bottom of the enclosure 8, and two outlet ports 12, located towards the top of the enclosure 8. The inlet ports 11 and/or the outlet ports 12 may be provided with a fan 13 that draws air through the inlet ports 11, into the interior 4 of the enclosure 8, over the garment 1 within the enclosure 8 and then out of the outlet port 12. In this way, a constant stream of fresh air 6 from outside the enclosure 8 is provided to the garment 1. Furthermore, when the device 7 is being used for drying a garment 1, it is important that the flow of air 6 passes out of the enclosure 8 so that water vapour is also removed from the interior 4 to control humidity. A dehumidifier or condenser (not shown) may also be provided on the outlet port 12 so that water is removed from the air to prevent the humidity of the atmosphere surrounding the device from increasing.

The device may also include a heater 14 positioned within or adjacent to the inlet ports 11, towards the bottom of the enclosure 8, so that air 15 entering the enclosure 8 via the inlet ports 11 is heated. In this way, heated air 6 is circulated through the enclosure 8, which will dry any wet garment 1 being treated. The air heater 14 may be operable separately to the other components of the enclosure 8 so that use of the heater 14 is optional. For example, the heater 14 may be operated if the device 7 is being used to dry a garment 1, and then disabled if the device 7 is being used to treat an already dry garment 1. The air heater 14 may be electrically powered.

Alternatively or additionally, the interior 4 of the enclosure 8 may be provided with an infrared (IR) lamp 16 operating in the near, mid and/or far infrared spectrums between 0.7 μ, and 1000 μm. The IR lamp 16 directly irradiates and therefore heats the garment 1, which causes water in the garment 1 to be evaporated into water vapour which is carried out of the enclosure 8 in the air flow 6, via the outlet port 12. The IR lamp 16 may be used when the device 7 is being employed to dry a garment 1, but the IR lamp 16 is not necessary for generating the desired characteristic smell on already dry garments. The IR lamp 16 may be electrically powered and a user operated switch, or a controller, may control when the IR lamp 16 are activated and at what power they operate.

The device 7 may also include a means for generating ozone which generates ozone ($O_3$) and directs it into the stream of air 6 moving over the garment 1. As previously explained, ozone is a strong oxidant and therefore accelerates the generation of the desired characteristic smell due to the interaction of the UV light 2 with the garment 1. The device may include an ozone generator 17 configured to emit ozone 18 into the inlet port 11, or directly into the interior 4 of the enclosure 8, as shown in FIG. 2. If the inlet port 11 is provided with a fan 13 to draw air through the inlet ports 11 into the interior 4 of the enclosure 8, the fan 13 may also draw ozone generated by the ozone generator 17 into the enclosure via the inlet port 11.

The ozone generator 17 may comprise a corona discharge generator, which includes a corona discharge tube to ionise oxygen in ambient air and produce ozone. Alternatively, the ozone generator may be any of a cold plasma generator, an electrolytic generator or a graphite cathode reaction generator. The ozone generator may be electrically powered and a user operated switch or a controller may control when the ozone generator is activated.

The means for generating ozone should be configured to provide the interior 4 of the enclosure 8 with an ozone concentration of between 0.02 parts per million (ppm) and 0.2 ppm. The required ozone production rate will depend on the magnitude of the air flow 6 through the enclosure 8 and also on the size of the enclosure 8. Ozone is extremely reactive and has a short half-life, meaning it can not dissipate far without breaking down into dioxygen ($O_2$). However, it can be detrimental to health and to avoid any possibility of dangerous concentrations of ozone leaving the enclosure 8 into the atmosphere surrounding the device 7, the outlet port(s) 12 of the enclosure 8 should be provided with a filter 19 to remove ozone from air 20 exiting the enclosure 8. The filter 19 may comprise an activated carbon filter or metal oxide filter which reacts with any ozone in the air 20 leaving the enclosure 8 to form oxides or dioxygen. At the end of use the air within the enclosure 8 will still have a high concentration of ozone. Therefore, at the end of a treatment cycle, prior the enclosure 8 being opened, the ozone generator 17 may be deactivated and the outlet fan 13 may remain active so that air is drawn out of the enclosure 8 and through the filter 19 which removes the ozone. Alternatively, a timer lock can be provided such that the device cannot be opened until the concentration of ozone within has dropped to a safe level.

Figure 3:
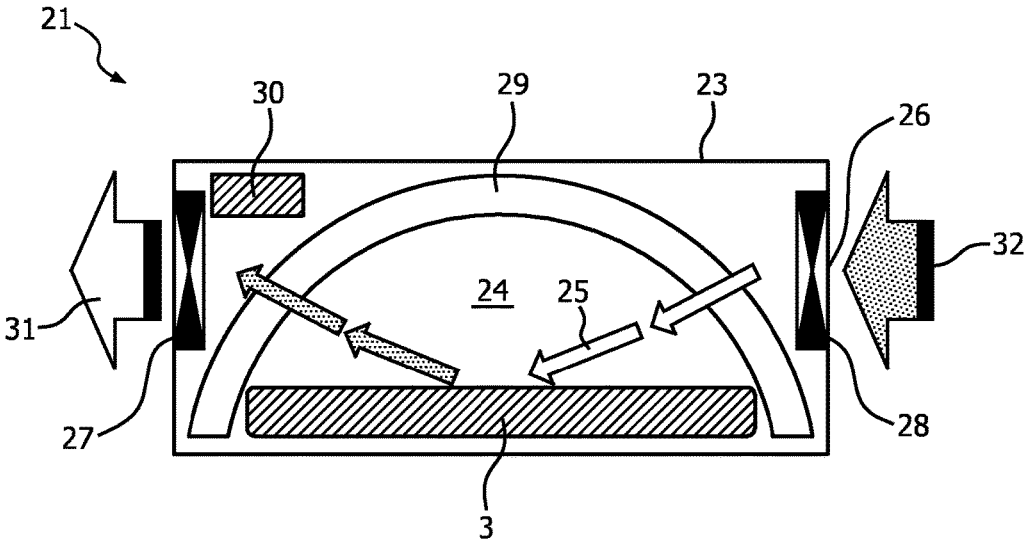
FIG. 3 shows an alternative embodiment of the invention in which a flow of air in an enclosed space is generated.
Figure 4:
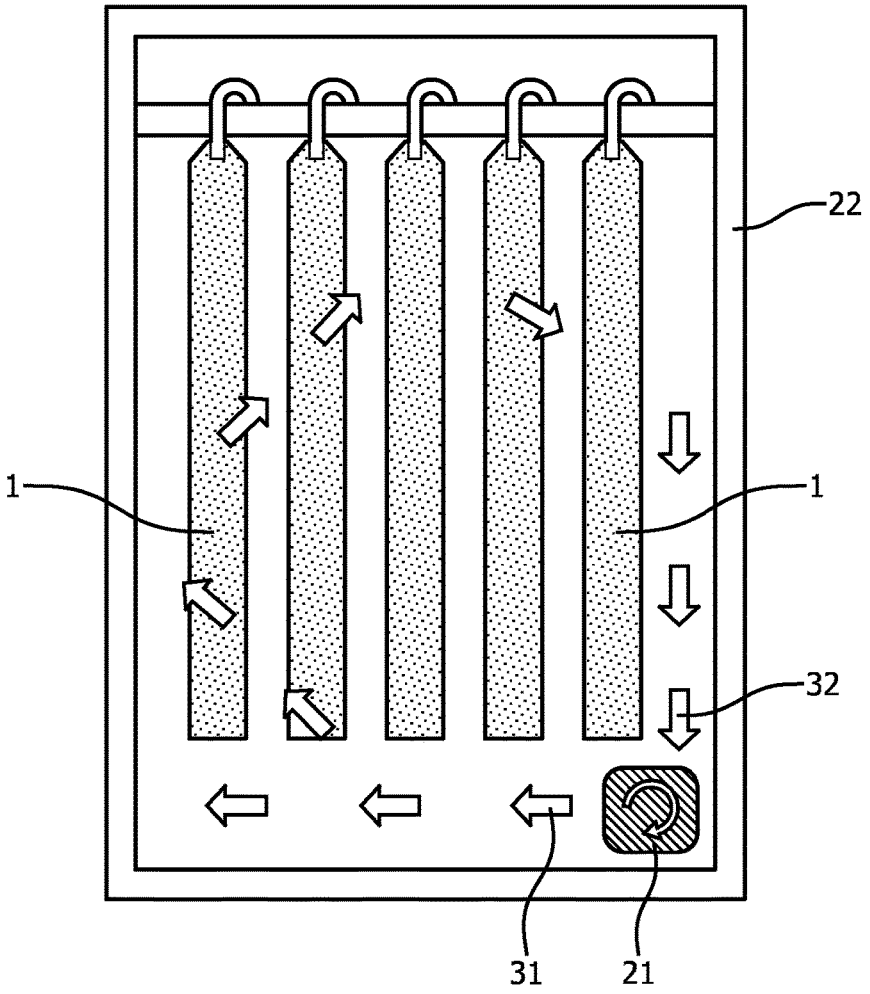
FIG. 4 shows the device of FIG. 3 positioned within a wardrobe to treat garments 1 within the wardrobe.

FIG. 3 and FIG. 4 show an alternative embodiment of the invention.

The device 21 of FIG. 3 comprises an enclosure 23 that defines an internal space 24 through which a flow of air 25 is generated. Air 32 is drawn into the internal space 24 through an inlet 26 and exits the internal space 24 through an outlet 27 in response to operation of a fan 28. A fabric article 29 is disposed within the internal space 24 and a UV lamp 3 is positioned to irradiate the fabric article 29 with UV light so that the fabric article 29 is provided with the desired characteristic smell, as previously described.

The fabric article 29 may be disposed within the enclosure 23 to divide the internal space 24 into two different areas, such that air 25 passing through the internal space 24 has to pass through the fabric 29. The air 31 that passes out of the enclosure therefore carries the desired characteristic smell to the area surrounding the device 21.

The process may include a plasma or ion generator 30, or similar apparatus, that causes air 31 passing out of the enclosure 23 to become charged. This has the effect of causing the scent molecules to be charged and better attach to the other fabric articles in the vicinity of the device, resulting in longer lasting scent. The device may additionally be provided with a heater (not shown) that heats the air as it passes through the enclosure. In this way, the atmosphere surrounding the device and/or the garments can be heated, which a user may find desirable.

The device 21 of the second embodiment can be significantly smaller than the garment treating device of the first embodiment because the garments do not need to be placed within the device. More specifically, the device can be used simply to treat the air passing through it and it can be placed in a wardrobe 22 (see FIG. 4) so that the air 32 circulates around garments placed in the wardrobe 22 and may impart at least some of the desired characteristics to those garments in addition to any objects placed within the device 21.

The device 21 may be connected to an external electricity source to power the components of the device 21. Alternatively, the device 21 may be battery powered so that the device 21 can easily be moved into different locations and placed inside wardrobes, airing cupboards or in small storage spaces to generate the desired characteristics and treat the air within that space.

In an alternative embodiment which is not shown in the Figures, the enclosure 23 of the device 21 of the second embodiment may be configured such that garments may be hung on it. In this way, the garment is positioned on the outside of the enclosure and the device generates air with the desired characteristic smell which is circulated directly to the garment.

The device according to the invention may also comprise a mechanism for moving the garments according to a predetermined pattern so that all of the garments are fully exposed to the UV light. Alternatively, or additionally, the UV lamp or lamps may move according to a predetermined pattern. If the internal surfaces of the enclosure are covered with UV-reflective surfaces, it may also be advantageous to provide a mechanism by which the reflective surfaces can move according to a predetermined pattern. The device may be provided with means for hanging garments within the enclosure so that they are spaced by a predetermined distance from each other and which may be a minimum of 3 cm.

The enclosure may also have at least one portion where the user can have visual assurance that the ultraviolet lamp itself is still functioning. This can consists of a transparent or translucent region fabricated with UV filtering property such that only visible light can pass through. Alternatively, the region can be provided with a fluorescent material that emits light upon exposure to the UV light used. The region provides an intuitive feedback to the user and also avoids the need for additional indicator lights.

The embodiment described with reference to FIG. 2 relates to a smell generating device which may also be used as a garment drying device. However, it will be appreciated that the method described with reference to FIG. 1, whereby ultraviolet light is irradiated onto a garment to generate pleasant sun-dried characteristics, may be applied to any application whereby a fabric article is present and a sun scent is required. For example, the apparatus may be disposed within a wardrobe, clothes carrying bag or other clothes hanging means and may be used to impart the desired characteristics or 'sunshine scent' to those garments in the vicinity or contained with the wardrobe or clothes carrying bag.

The method and device described with reference to FIGS. 1 to 4 can also be used to treat articles other than garments, for example upholstery or other fabrics.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A method of treating a fabric article so that it is imparted with a characteristic smell normally associated with fabric articles that have been exposed to natural sunlight, the method comprising:

positioning a fabric article to be treated in an enclosure, irradiating, by one or more ultraviolet lamps under control of a controller, said fabric article positioned in said enclosure with ultraviolet light with a wavelength of between 280 nm and 320 nm for a first time period, and irradiating, by said one or more ultraviolet lamps under control of said controller, said fabric article positioned in said enclosure with ultraviolet light with a wavelength of between 320 nm and 400 nm for a second time period, distributing charged particles via an ion generator situated an exit region of the enclosure causing surrounding air passing out of the enclosure at said exit region to become charged, switching off the ultraviolet light once a required radiant exposure is achieved to impart said characteristic smell, wherein said combined irradiation subjects said fabric article to a predetermined radiant exposure in a particular time order for a first and second specified time interval, wherein the interior of the enclosure comprises a plurality of UV-reflective surfaces that have a UV-reflectivity of 80% or more, and wherein the intensity ratio between ultraviolet light with a wavelength between 280 nm and 320 nm and ultraviolet light with a wavelength between 320 nm and 400 nm, is between 1:4 and 1:30 wherein said overall predetermined radiant exposure is at least 18 $kJ/m^2$.

2. The method of claim 1, further comprising the step of providing ozone to the vicinity of said article being treated at a concentration of between 0.02 and 0.2 parts per million.

3. The method of claim 1, further comprising the step of locking a door via a timer lock for a first time period and a second time period.

4. The method of claim 1, further comprising the step of heating the air entering the enclosure via a heating device positioned within or adjacent an inlet port.

5. The method of claim 1, wherein the enclosure further comprises at least one fan configured to draw air into the enclosure via an inlet port and out of the enclosure via said outlet port.

6. The method of claim 1, wherein the outlet port includes a filter to remove ozone from the air leaving the enclosure.

* * * * *